US005437707A

United States Patent [19]

Cross

[11] Patent Number: 5,437,707

[45] Date of Patent: Aug. 1, 1995

[54] APPARATUS FOR TREATING IRON ORE

[76] Inventor: Mark Cross, 5, The Priors, Harriotts Lane, Ashtead, Surrey KT21 2QF, England

[21] Appl. No.: 233,438

[22] Filed: Apr. 28, 1994

[51] Int. Cl.[6] ..... F27B 7/28

[52] U.S. Cl. ..... 75/474; 75/479; 266/173

[58] Field of Search ..... 75/479, 474; 266/173

[56] References Cited

U.S. PATENT DOCUMENTS

| | | | |
|---|---|---|---|
| 2,091,850 | 8/1937 | Göhre | 266/173 |
| 2,925,336 | 2/1960 | Stowasser | 75/755 |
| 3,831,913 | 8/1974 | Ando | 75/479 |
| 3,881,916 | 5/1975 | Serbent et al. | 75/481 |

FOREIGN PATENT DOCUMENTS

| | | |
|---|---|---|
| 1047226 | 6/1958 | Netherlands . |
| 1439488 | 6/1976 | United Kingdom . |
| 2098190 | 11/1982 | United Kingdom . |

OTHER PUBLICATIONS

Rierson, David W.; "The Ported Kiln Concept as Applied to the Grate-Kiln System"; AIME Duluth Symposium; Jan. 1993.

*Primary Examiner*—Peter D. Rosenberg

*Attorney, Agent, or Firm*—Dickinson, Wright, Moon, Van Dusen & Freeman

[57] ABSTRACT

Apparatus for treating iron ore, comprising an elongate and generally cylindrical inclined kiln mounted for rotation about its longitudinal axis. A drive motor is coupled to the kiln to rotate the latter about that axis. A moving grate is positioned at the upper end of the kiln to feed iron ore pellets into the kiln while the latter is rotating. Port-defining means are provided in the generally cylindrical wall of the kiln to enable gaseous material to be fed into the interior of the kiln at at least one position between the ends thereof. The port-defining means are of such a construction that they are open when they are underneath the iron ore in the kiln. Gaseous oxidizing material feed means are connected to the port-defining means to feed such oxidizing material thereto, whereby oxidizing gaseous material is passed through the iron ore in the kiln when the apparatus is in use so as to raise the temperature of the iron ore, by oxidation thereof, and cause the latter to be indurated. The rate at which gaseous oxidizing material is fed to the port-defining means is dependent upon the interior temperature of the kiln.

4 Claims, 4 Drawing Sheets

APPARATUS FOR TREATING IRON ORE

The present invention relates to the treatment of iron ore.

Hitherto, magnetite iron ore having the formula $Fe_3O_4$ has been formed into moist pellets which are then indurated to enable them to withstand the temperatures and forces which they are subjected to in a blast furnace when the iron is extracted from the ore.

One previously proposed construction of apparatus for effecting such induration is shown in FIG. 1, which shows a diagrammatical elevational view of such apparatus. It includes a chute (usually a roller feed screen) 10 to supply green or cold wet pellets with 8–10% moisture onto the beginning of a moving grate 12 (usually referred to as a rotary grate system). The latter extends through drying and pre-heating enclosures 13, 15 and 17 through which is drawn heated air or gas by means of pumps 14, 16 and 18 respectively.

Typically the cold wet iron ore pellets 8 are supplied to the moving grate 12 to a depth of 15 to 20 cm, the grate being about 5 m wide and 50 m long. The iron ore pellet bed passes through two drying zones 20 and 22 within the enclosures 13 and 15 respectively, and finally through a pre-heating zone 24 in the enclosure 17. The second drying zone 22 is supplied with hot air at 500° C. to 700° C. from the off-gas of a grate cooler system of the apparatus. The hot gas flowing through the pre-heat zone 24 at about 1000° C. to 1200° C. is the off-gas from the rotary kiln. The gas flowing into the first drying zone at about 300° C. is usually the off-gas from the pre-heat zone.

At a finishing position of the moving grate 12 there is provided a chute 30 extending to an upper end of a cylindrical rotary kiln 32. The kiln is about 5 m in diameter and about 50 m in length. It is mounted on rotary bearings 34 at an inclination of about 2°. A drive motor 36 is coupled to one of the bearings 34 to rotate the kiln 32 at about one revolution per minute.

An exit chute 38 is provided at the lower end of the kiln 32 to direct the indurated pellets onto a second moving grate 40, in this case constituting a rotary cooler. This grate is about 3 m wide and with an effective length of 50 m, but here the indurated pellets are loaded on this conveyor to a depth of about 0.75 m.

The region above the moving grate is usually divided into two zones by adjacent enclosures 42 and 43. Cold air is pumped through ducts 44 by pumps 45 and thence through the pellet bed on the grate 40. The heated air from the primary, upstream cooling zone defined by the enclosure 42 passes into the kiln 32. Air from the second, downstream air cooling zone defined by the enclosure 43 passes through a recoup duct 48 to the drying zone 22.

As the pellets fall from the moving grate 40 they are transported to a storage area (not shown) by a conventional rubber conveyor belt 50.

A duct 54 guides hot gases exiting the kiln 32 to the pre-heating zone 24 of the moving grate 12.

A burner 56 is mounted in the enclosure 42 and extends into the kiln. The burner 56 is directed to throw a flame into the interior of the kiln 32 above the iron ore pellets therein.

Typically a pyrometer 58 is sited in the enclosure 42 and is directed at the top of the bed in the kiln to provide a measurement of the peak temperature of the pellet bed within the kiln 32. The fuel fed to the burner 56 is controlled manually by a control valve 60 to maintain a desired peak pellet temperature.

During operation of the apparatus shown in FIG. 1, after the iron ore pellets 8 have passed through the two drying zones 20 and 22 and the pre-heating zone 24, at which they reach temperatures of about 100° C., 400° C. and 900° C. respectively, they fall under gravity from the moving grate 12 to the chute 30 and thence to the upper end of the kiln 32. Here, the slow rotation of the kiln ensures that the pellets are moved about continually so that they become evenly heated and thereby indurated, and at the same time move steadily down the kiln 32 to the lower end thereof. They continue to fall under the force of gravity down the chute 38 onto the second moving grate 40. The grate transports the pellets through the cooling zones within the enclosures 42 and 43, and then onto the conveyor belt 50 to the storage location.

It will thus be seen that, typically, the first drying zone 20 receives its hot air from the off-gas duct 18 from the pre-heat zone 24. The second stage drying zone 22 receives its hot air from the exit gas of the second stage cooling zone defined by the enclosure 43 via the recoup duct 48. The pre-heating zone 24 is provided with even hotter gases from the kiln 32 via the duct 54.

In the firing zone within the kiln 32, the temperature of the pellets rises typically to about 1,300° C. FIG. 5 shows the variation of temperature with distance along the kiln from the higher end thereof to the lower end. The broken curve represents the temperature of the gases and the solid curve the temperature of the pellets, the latter peaking at about 1,300° C. The temperature represented by the abscissa is 0° C. Both the temperature and distance scales are linear.

Very little oxidation of the pellets occurs inside the kiln in the foregoing process. If the stages in the process are defined as (i) the first drying stage in the first drying zone 20, (ii) the second drying stage in the second drying zone 22, (iii) the pre-heating stage in the pre-heating zone 24, (iv) the firing stage in the kiln 32, (v) the cooling stage in the cooling zones defined by the enclosures 42 and 43, then the magnetite contents at the ends of these stages, compared with the initial content, are respectively about (i) 90%, (ii) 85%, (iii) 30%, (iv) 28%, and (v) 2%.

The apparatus and process described above consumes about 350,000 British Thermal Units of energy per tonne of indurated iron ore pellets produced. It is therefore very expensive to run.

The present invention seeks to provide a remedy.

Accordingly, the present invention is directed to apparatus for treating iron ore, comprising an elongate and generally cylindrical inclined kiln mounted for rotation about its longitudinal axis, drive means coupled to the kiln to rotate the latter about that axis, iron ore feed means positioned at the upper end of the kiln to feed iron ore into the kiln while the latter is rotating, and port-defining means in the generally cylindrical wall of the kiln to enable gaseous material to be fed into the interior of the kiln at at least one position between the ends thereof, in which the port-defining means are of such a construction that they are open when they are underneath the iron ore in the kiln, and in which gaseous oxidising material feed means are connected to the port-defining means to feed such oxidising material thereto, whereby oxidizing gaseous material is passed through the iron ore in the kiln when the apparatus is in use so as to raise the temperature of the iron ore, by oxidation thereof, and cause the latter to be indurated, the apparatus further comprising temperature measuring means arranged to provide a measurement of an interior temperature of the kiln and control means connected to the gaseous oxidising material feed means to vary the rate at which gaseous oxidising material is fed to the port-defining means in dependence upon the said measurement so as to maintain the peak temperature of the iron ore in the kiln within a predetermined range.

Preferably, that range is from 1,270° C. to 1,340° C., depending upon chemical additives included in the iron ore.

The present invention extends to a method of treating iron ore, comprising feeding iron ore into the upper end of a rotary elongate generally cylindrical inclined kiln, and feeding gaseous oxidising material through port-defining means in the wall of the kiln at positions underneath the iron ore in the kiln, whereby the gaseous oxidising material passes through the iron ore in the kiln to raise the temperature of the iron ore by oxidation thereof and cause the latter to be indurated, and in which an interior temperature of the kiln is measured, and the rate at which the gaseous oxidising material is fed to the port-defining means of the kiln is varied in dependence upon the measured temperature, so as to maintain the peak temperature of the iron ore in the kiln within a predetermined range.

Preferably, that range is from 1,270° C. to 1,340° C., depending upon chemical additives included in the iron ore.

An example of apparatus as well as an example of a method in accordance with the present invention is illustrated in the accompanying drawings in which.

The prior art shown in FIG. 1 has already been described in detail. The parts shown in FIG. 2 which correspond to parts shown in FIG. 1 have the same reference numerals. The FIG. 2 apparatus differs from that shown in FIG. 1 in the following respects.

Figure 1:
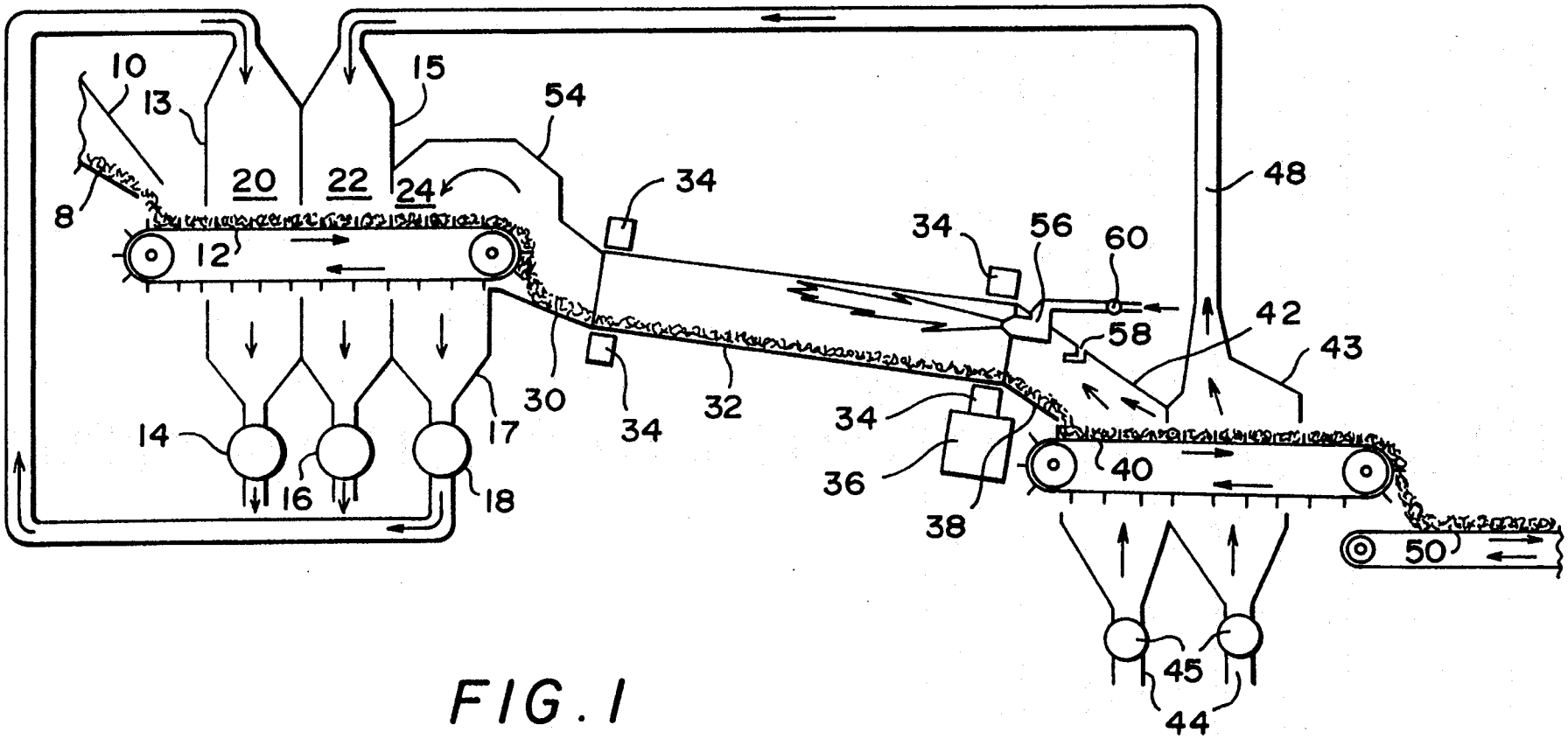
FIG. 1 is a diagrammatical elevational view of a prior construction of apparatus.

a) the kiln 32 is ported by port-defining means 69 at intervals spaced apart around two annuli 70 which in turn are spaced apart along the length of the kiln, one of the annuli being roughly mid way between the ends of the kiln, and the other being closer to the upper end of the kiln;

b) these annuli 70 are surrounded by enclosure rings 72 which remain stationary and form a seal with the rotated kiln;

c) both enclosure rings 72 are connected by a common gallery 74 which in turn is connected to the enclosure 42 via a further duct 76;

d) a valve and/or pump 78 is provided in the duct 76, and can be adjusted to vary the amount of heated air from the enclosure 42 that is passed to the ring enclosures 72;

e) an automatic electronic controller 79 is connected to the pyrometer 58, to the control valve 60, and to the valve and/or pump 78.

Figure 3:
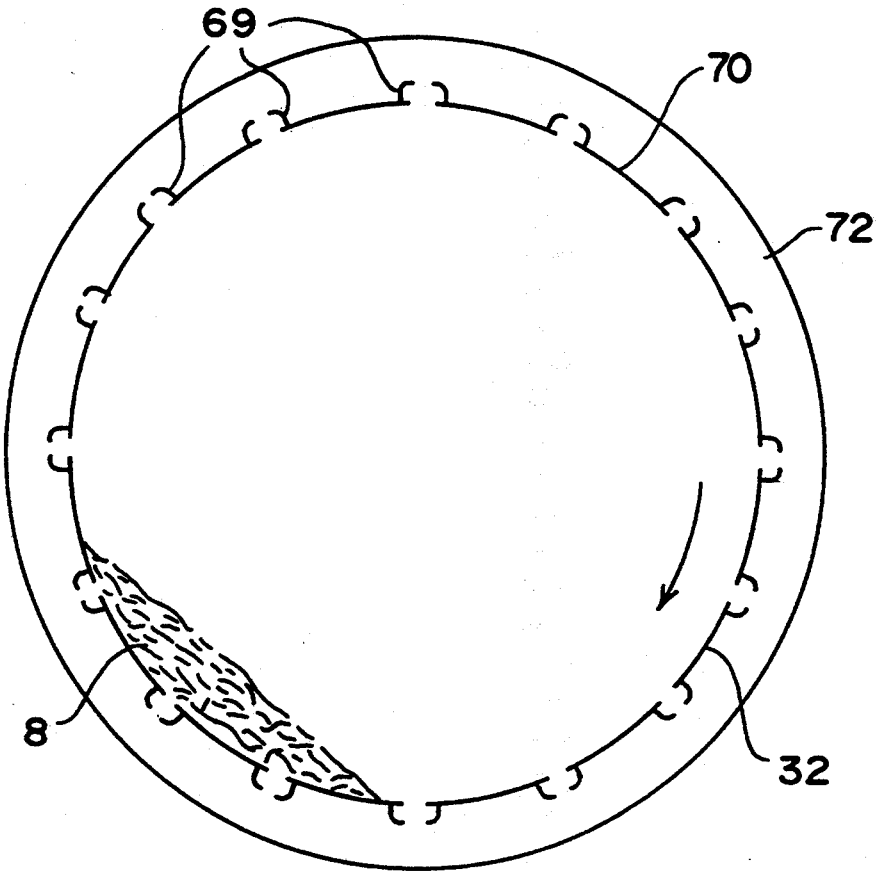
FIG. 3 is a diagrammatical sectional view of a kiln of the apparatus shown in FIG. 2 taken in the plane represented by the line III—III thereof.

As shown in FIG. 3, which views the kiln interior in the direction from the lower end thereof to the upper end thereof, the kiln rotates in a clockwise sense in this direction. Consequently the iron ore bulk within the kiln resides on the interior kiln wall for the time being slanting upwardly to the left of the lower-most position of the kiln wall, as shown in FIG. 3.

Figure 4:
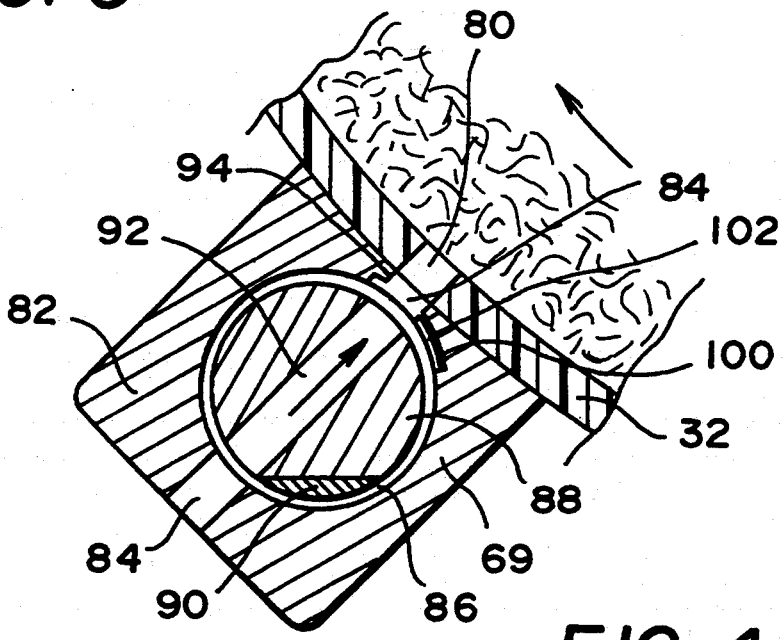
FIG. 4 is a sectional view through port-defining means of the apparatus shown in FIGS. 2 and 3.

A cross-section through one of the port-defining means 69 is shown in greater detail in FIG. 4, although it must be emphasised once again that this construction is given by way of example only. The port-defining means therein are for the time being underneath the iron ore bulk within the kiln. The port-defining means 69 are adjacent to an aperture 80 shown in the wall of the kiln 32, and comprise a block 82 through which extends a through-bore 84, which is in direct registration with the aperture 80 in the wall of the kiln 32. At right angles to the this through-bore 84 extends a cylindrical transverse bore 86 of substantially larger cross sectional diameter than the through-bore 84. A cylindrical block 88, having an external diameter slightly smaller than the transverse bore 86, extends therewithin, and is free to rotate therewithin about its axis of revolution. The cylindrical block 88 is provided with a weight 90 on one side. As a result, this weight 90 will always be positioned on the underside of the cylinder 88 regardless of the orientation of the block 82 as the kiln rotates.

A through-bore 92 extends through the cylindrical block 88 transversely of its axis of revolution, and, when the block 82 has the orientation shown in FIG. 4, is in registration with the through-bore 84 in the block 82. As a result, gaseous material is free to flow from the outer side of the block 82, through the bores 82 and 92, through the aperture 80 in the kiln wall 82 and thence to the interior of the iron ore bulk in the kiln interior.

A refractory mesh 94 may be provided to prevent any solids from the kiln interior falling into the port-defining means. Alternatively, the aperture 80 may actually comprise a multitude of small apertures in the region defined by what is shown as an aperture 80 in FIG. 4.

In order that the port-defining means 69 do not open again at a position which is diametrically opposite that represented in FIG. 4, a slot 100 is provided in the interior of the block 82, around the transverse bore 86 and adjacent to the inner end of the through-bore 84. A closure member 102 rests within the slot 100, and is freely moveable from the position it occupies as shown in FIG. 4, in which it is wholly underneath the inner end of the through bore 84, to a position in which it lies entirely across that through bore 84, to close the latter. It will be seen therefore that by the time the block 82 reaches the position which is diametrically opposite that which it occupies in FIG. 4, the closure member 102 will have been slid under the force of gravity into its closing position. However, before the position it occupies in FIG. 4 is reached once again, the closure number 102 will have slid back to the open position.

Figure 2:
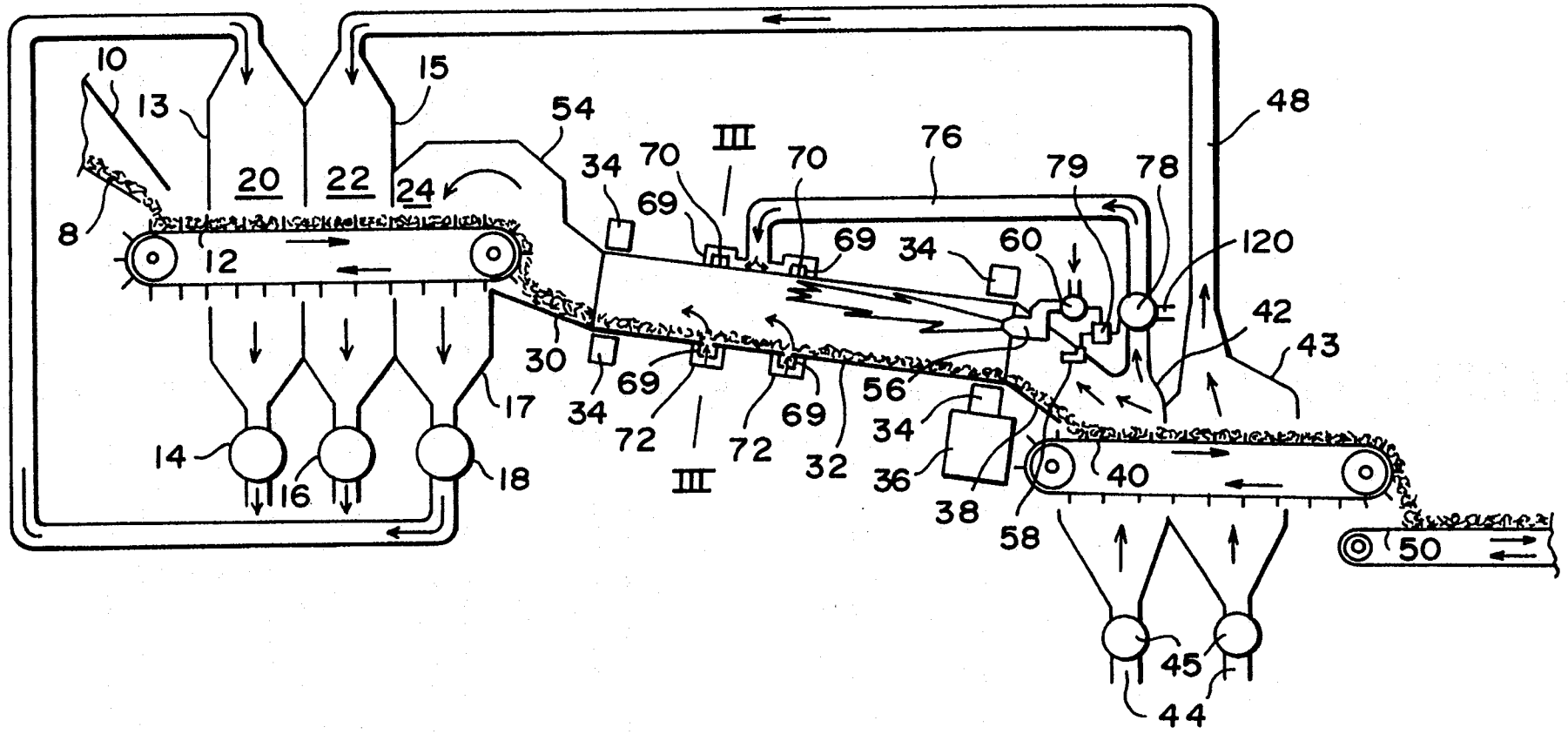
FIG. 2 is a corresponding diagrammatical elevational view of apparatus embodying the present invention.

Thus it will be seen that during operation of the apparatus shown in FIG. 2, a substantial amount of air from the cooling enclosure 42 is fed to the enclosure rings 72 and through the port-defining means 69 which are for the time being underneath the iron ore pellets in the kiln 32. This heated air therefore passes through the iron ore pellets. As result, the pellets heat up by virtue of the magnetite present within them being converted to hematite during the following exothermic chemical oxidation process:

$$4Fe_3O_4+O_2 \rightarrow 6Fe_2O_3.$$

Figure 5:
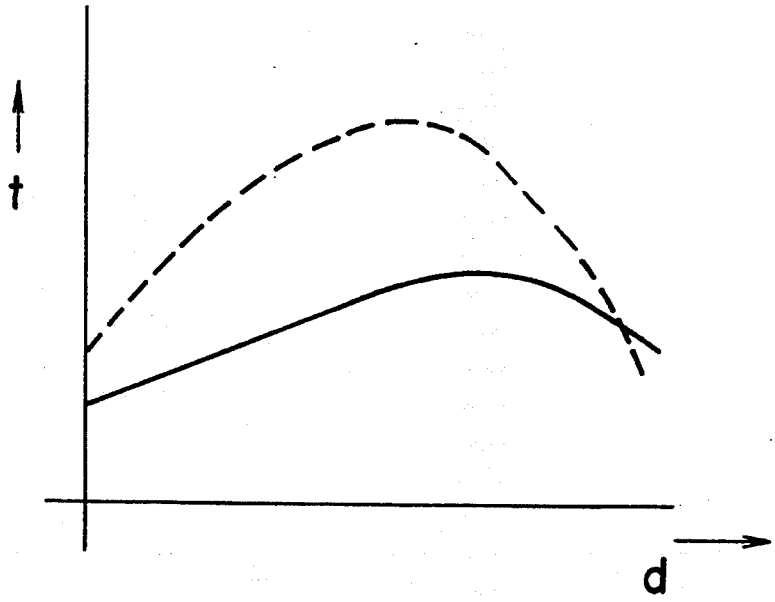
FIGS. 5 and 6 show respective explanatory graphs.
Figure 6:
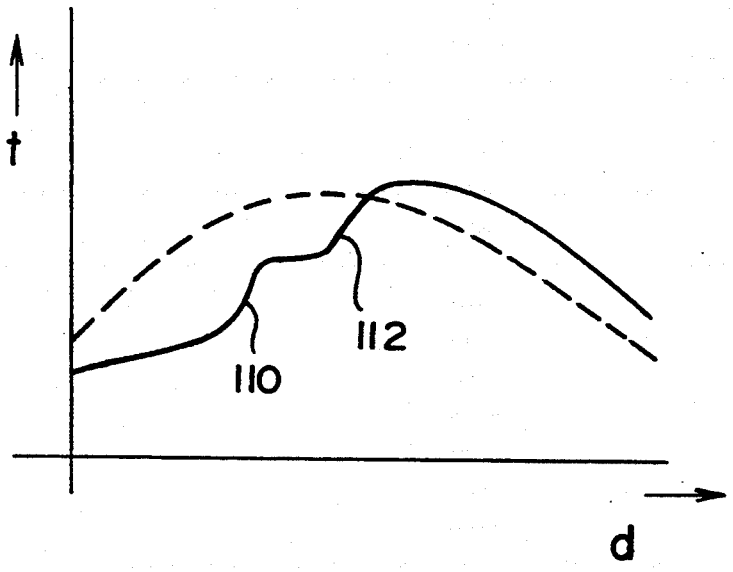

This results in a considerable increase in temperature of the iron ore pellets at the positions of the enclosure rings 72, and results in the temperature curve shown in FIG. 6, in which temperature is plotted along the ordinate, and distance along the kiln from its upper end to its lower end is plotted along the abscissa. The latter thus represents 0° C. Both scales are linear. As in FIG. 5, the broken curve represents the temperature of the gases within the kiln and the solid curve represents the temperature of the solids within the kiln. The positions represented by the steep inclinations 110 and 112 respectively in FIG. 6 correspond to the positions of the two rings 72 around the kiln 32.

It is thus seen that the temperature of the solids towards the lower end of the kiln actually exceeds that of the gases and the amount of energy consumed by the fuel within the kiln in order to maintain a peak temperature at about 1,300° C., is dramatically less, perhaps as low as 80,000 British Thermal Units per tonne of indurated pellets produced, although it will be appreciated that any consumption of energy below 200,000 British Thermal Units per tonne of indurated pellets would represent a significant saving.

Whilst it is still possible in the apparatus shown in FIG. 2 to maintain the peak temperature of the iron ore in the kiln at an even 1,300° C. by adjusting the supply of fuel of the burner 56, priority of control will be given by the controller 79 to the valve and/or pump 78 in the duct 76, whilst keeping the fuel consumed by the burner 56 to a minimum. Thus, in the event that the peak temperature of the pellets in the kiln 32 falls significantly below 1,310° C., as measured by the pyrometer 58, the controller 79 will accordingly increase the flow rate through the duct 76 to increase the supply of oxygen to the enclosure rings 70. This increases the exothermic oxidation of the iron ore to raise the temperature until it returns once again to 1,310° C. Conversely, if the temperature significantly exceeds 1,310° C., the flow rate through the duct 76 will be decreased by the controller 79.

As a result, the magnetite content at the end of the five stages referred to herein are respectively about (i) 90%, (ii) 85%, (iii) 30%, (iv) 17%, and (v) 2%.

The controller 79 will only increase the flow of fuel to the burner 56 in the event that the desired temperature cannot be reached merely by increasing the flow of oxygen enriched air though the duct 76.

In certain circumstances, it is possible that the controller 79 may shut down the burner 56 altogether, or close it to a level which is just sufficient to maintain a flame, in the event that the exothermic oxidation process is entirely sufficient to maintain the desired temperature within the kiln.

Many modifications to the illustrated apparatus and method will occur to a man of ordinary skill in the art without taking the apparatus or method outside the scope of the present invention.

For example, a substantial proportion of the air drawn into the enclosure 42 may eventually pass to the enclosure 13, directly or via the kiln interior, to eliminate the need to recoup the gases from the pre-heat zone 24 to the first drying zone 20.

An additional pump may be positioned in the duct 48 to assist flow of air therethrough.

Instead of or in addition to passing the air from the cooling enclosure 42 to the rings 72, pure oxygen or enriched air may be passed to those rings via an inlet 120 to the pump/valve 78.

The ported kiln 32 shown in FIG. 2 may utilise the Boliden-Allis ported kiln technology.

A proportion of the off-gas from either the first or second cooling zones (or both) may be directed into the valve/pump 78 (where it is possibly mixed with oxygen) and thence to the annuli 70.

All of the air or gas pumps may be centrifugal fans, for example.

I claim:

1. Apparatus for treating iron ore, comprising an elongate and generally cylindrical inclined kiln mounted for rotation about its longitudinal axis, an upper end of the kiln, wall means defining an interior of the kiln, drive means coupled to the kiln to rotate the latter about its longitudinal axis, iron ore feed means positioned at the upper end of the kiln to feed iron ore into the kiln while the latter is rotating, port-defining means in the generally cylindrical wall of the kiln to enable gaseous material to be fed into the interior of the kiln at at least one position between the ends thereof, which port-defining means are of such a construction that they are open when they are underneath the iron ore in the kiln, and gaseous oxidising material feed means connected to the port-defining means to feed such oxidising material thereto, whereby oxidizing gaseous material is passed through the iron ore in the kiln when the apparatus is in use so as to raise the temperature of the iron ore, by oxidation thereof, and cause the latter to be indurated, the apparatus further comprising temperature measuring means arranged to provide a measurement of an interior temperature of the kiln and control means connected to the gaseous oxidising material feed means to vary the rate at which gaseous oxidising material is fed to the port-defining means in dependence upon the said measurement so as to maintain the peak temperature of the iron ore in the kiln within a predetermined range.

2. Apparatus according to claim 1, in which the said predetermined range is from 1,270° C. to 1,340° C., depending upon chemical additives included in the iron ore.

3. A method of treating iron ore in a rotary elongate generally cylindrical inclined kiln having an upper end and wall means defining an interior of the kiln, the method comprising feeding iron ore into the said upper end, feeding gaseous oxidising material through port-defining means in the wall of the kiln at positions underneath the iron ore in the kiln, whereby the gaseous oxidising material passes through the iron ore in the kiln to raise the temperature of the iron ore by oxidation thereof and causes the latter to be indurated, in which an interior temperature of the kiln is measured, and the rate at which the gaseous oxidising material is fed to the port-defining means of the kiln is varied in dependence upon the measured temperature, so as to maintain the peak temperature of the iron ore in the kiln within a predetermined range.

4. A method according to claim 3, in which the said predetermined range is from 1,270° C. to 1,340° C., depending upon chemical additives included in the iron ore.

* * * * *